US006491500B1

(12) United States Patent
Sun et al.

(10) Patent No.: US 6,491,500 B1
(45) Date of Patent: Dec. 10, 2002

(54) SCROLL COMPRESSOR WITH MOTOR PROTECTOR IN NON-ORBITING SCROLL AND FLOW ENHANCEMENT

(75) Inventors: Zili Sun, Arkadelphia, AR (US); Jason Hugenroth, Hope, AR (US); Robert Carl Witham, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/702,623

(22) Filed: Oct. 31, 2000

(51) Int. Cl.[7] ..... F04B 49/10
(52) U.S. Cl. ..... 417/32; 417/18
(58) Field of Search ..... 417/32, 18, 44.1, 417/292

(56) References Cited

U.S. PATENT DOCUMENTS

| | | | | | |
|---|---|---|---|---|---|
| 5,118,260 | A | * | 6/1992 | Fraser, Jr. | 417/18 |
| 5,200,872 | A | * | 4/1993 | D'Entremont et al. | 361/25 |
| 5,368,446 | A | * | 11/1994 | Rode | 417/18 |
| 5,452,989 | A | | 9/1995 | Rood | |
| 5,527,158 | A | * | 6/1996 | Ramsey et al. | 417/32 |
| 5,707,210 | A | * | 1/1998 | Ramsey et al. | 417/32 |
| 6,095,765 | A | * | 8/2000 | Khalifa | 417/310 |

FOREIGN PATENT DOCUMENTS

| | | | | |
|---|---|---|---|---|
| EP | 1158641 | AB | | 11/2001 |
| GB | 2360329 | A | | 9/2001 |
| JP | 0700189954 | | | 7/1995 |
| JP | 09203388 | | * | 8/1997 |

OTHER PUBLICATIONS

Int'l Search Report, Mar. 25, 2002.

* cited by examiner

*Primary Examiner*—Henry Bennett
*Assistant Examiner*—Quang Van
(74) *Attorney, Agent, or Firm*—Carlson, Gaskey & Olds

(57) ABSTRACT

A scroll compressor is provided with a motor protector mounted at a location remote from the motor. The motor protector is of the sort which operates to stop operation of the motor both when the temperatures in the scroll compressor increases, and when the electrical characteristics of the power supplied to the motor depart from those from which are expected. Preferably, the motor protector is mounted in the non-orbiting scroll. Further, the invention includes means to increase the sensitivity of this motor protector to conditions indicative of an outdoor fan failure. In several embodiments, these means include a valve which opens to communicate hot discharge pressure refrigerant over the valve. In one other embodiment, this means is a heat sink operable to take heat away from the motor protector. In this last embodiment, when the volume flow of refrigerant decreases, the amount of heat taken away also decreases.

9 Claims, 5 Drawing Sheets

SCROLL COMPRESSOR WITH MOTOR PROTECTOR IN NON-ORBITING SCROLL AND FLOW ENHANCEMENT

BACKGROUND OF THE INVENTION

This application relates to a scroll compressor having a motor protector incorporated into the compressor at a location remote from the motor, and further having structure for enhancing the flow of refrigerant across the protector in the event of a high discharge pressure condition.

Scroll compressors are becoming widely utilized in refrigerant compressor applications. As known, a scroll compressor includes two scroll members each having a base and a generally spiral wrap extending from the base. The wraps interfit to define compression chambers. One of the two scroll members is caused to orbit relative to the other, and as the two orbit the size of the compression chambers decrease, compressing an entrapped refrigerant.

There are many design challenges in the use of scroll compressors. One design challenge occurs when there is a loss of charge in the refrigerant cycle. In such situations, the pressure ratio of the discharge pressure to suction pressure increases greatly. This results in additional heat, and is detrimental to the operation of the compressor, and the entire refrigerant system. It is desirable to sense such a condition as quickly as possible and stop operation of the compressor.

Modern compressors are typically powered by an electric motor. The electric motor is provided with a motor protector which stops operation of the motor should anyone of a number of conditions be sensed. One particular condition is excess heat in the compressor housing which is sensed by the motor protector. In addition, anomalies in the electric current or voltage being supplied to the motor will also cause the protector to stop operation.

Recently, the Assignee in the above-referenced invention has invented the concept of locating the motor protector at a location remote from the motor. In this way, the protector can sense the occurrence of high temperature causing conditions more rapidly, and thus can stop the compressor more rapidly. U.S. patent application Ser. No. 09/527,428 entitled "Motor Protector on Non-Orbiting Scroll" and filed on Mar. 16, 2000 is disclosed in the base of the non-orbiting scroll. While this location is quite beneficial, it would be desirable to increase the efficiency of this motor protector identifying the improper conditions and stopping operation of the motor.

SUMMARY OF THE INVENTION

In disclosed embodiments of this invention, a scroll compressor is provided with a motor protector located at a location remote from the motor. Further, valving is preferably provided to identify conditions indicative of an outdoor fan failure, and in particular, high pressure differentials. When such conditions are identified, discharge pressure refrigerant is allowed to flow over the motor protector. Under outdoor fan failure or blocked fan conditions, the discharge refrigerant will be hotter than normal. The motor protector will promptly stop operation of the motor. More broadly, the invention could be said to include a number of ways of providing increased sensitivity to conditions indicative of the outdoor fan failure at the motor protector.

Again, in preferred embodiments, a relief valve which is open when the discharge to suction pressure differential exceeds a predetermined value, is positioned to allow discharge refrigerant to pass over the protector when opened. In embodiments, this valve may be located in the base of the non-orbiting scroll, may be located in a protective cover on the non-orbiting scroll, or may be located in an outer suction passage leading to the beginning of the compression chambers in the non-orbiting scroll. In this latter embodiment, the motor protector is further located in this outer suction area. With this embodiment, no additional height is required for either the motor protector or the relief valve.

In a further embodiment, a heat sink is provided both above and below the motor protector. As the discharge refrigerant passes over this heat sink, heat is taken away from the motor protector. However, in a loss of charge situation the volume flow of this refrigerant will decrease. Further, the refrigerant will typically have a higher temperature. Thus, the heat transfer from this heat sink will also decrease. The motor protector will thus increase in temperature, and soon trips and stop operation of the motor.

These and other features of this invention can be understood from the following specification and drawings, the following of which is a brief description.

DETAILED DESCRIPTION OF A PREFERRED EMBODIMENT

Figure 1:
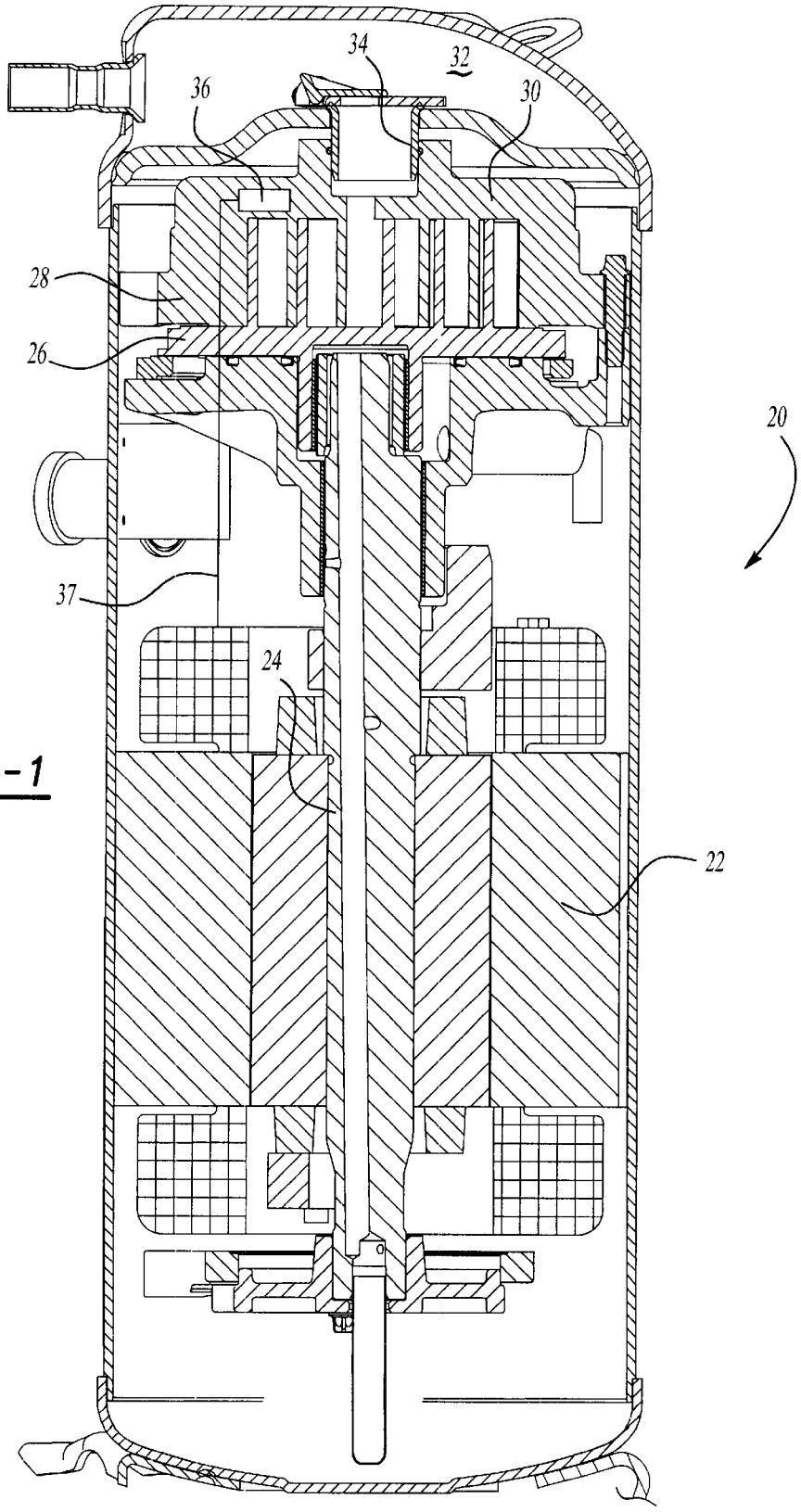
FIG. 1 is a cross-sectional view of a schematic representation of the inventive scroll compressor.

A scroll compressor 20 is illustrated in FIG. 1 and incorporates a motor 22 driving a shaft 24. Shaft 24 drives an orbiting scroll 26, which orbits relative to a non-orbiting scroll 28. Non-orbiting scroll 28 has a base 30. A discharge pressure chamber 32 is defined outwardly of the base 30, and a discharge port leads from compression chambers between the wraps of the scroll members 26 and 28 to the chamber 32. Typically, a separator plate is positioned between chamber 32 and the base 30. However, in some recently developed scroll compressors the separator plate has been eliminated.

A motor protector system 36 includes a motor protector along with structure for increasing the sensitivity of the motor protector to conditions indicative of an outdoor fan failure situation. As shown, a wire 37 communicates the motor 22 to the motor protector. As is disclosed in the above-referenced U.S. patent application Ser. No. 09/527,428, the circuitry for the motor protector may be as known. It is the location of the motor protector which is inventive in this application. Moreover, while the particular motor protector is disclosed in the base 30 of the non-orbiting scroll, it should be understood that the benefits of this invention can be achieved by locating the motor protector at locations other than the base of the non-orbiting scroll. Instead, merely locating the motor protector at locations remote from the motor 22 in combination with the other disclosed embodiments relating to providing increased sensitivity will provide benefits according to this invention.

Figure 2:
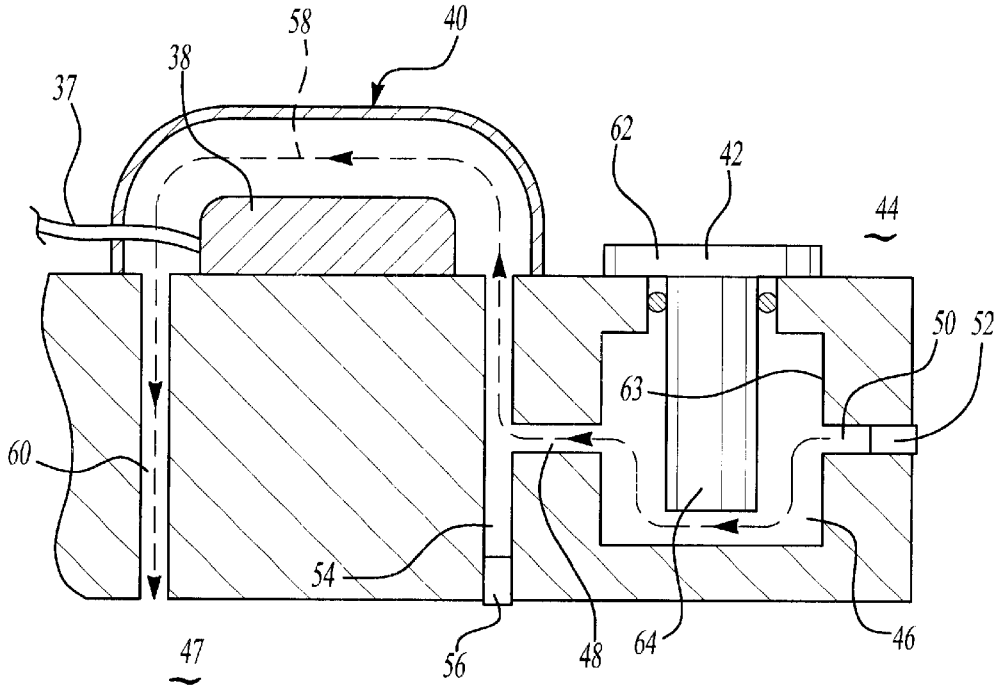
FIG. 2 is an enlarged view of a first embodiment.

FIG. 2 shows a first embodiment where a metal cover 40 protects and insulates the motor protector 38. A pressure relief valve 42 sees a discharge pressure from chamber 44 on a first side, and a suction pressure from chamber 46, which communicates with a suction chamber 47 on a second side. The pressure relief valve 42 may be as known, and serves to open and communicate the chambers 44 and 46 when the pressure differential exceeds a predetermined maximum. As is known, in the event there is an outdoor fan failure in the refrigerant cycle, the pressure differential increases, and thus the valve 42 opens to allow discharge pressure refrigerant to move from chamber 44 to chamber 46. From chamber 46 the refrigerant will pass through a passage 48. As is shown, the passage 48 is formed by drilling through a passage 50 and passage 48 and then plugging 52 the passage 50. The passage 48 communicates with another passage 54 extending generally perpendicular to the passage 48. Again, a plug 56 closes one end of the passage 54. The passage 54 communicates with a chamber 58 surrounding the protector 38 at its second end. Another passage 60 communicates with the chamber 47 from the chamber 58. Now, during normal operation when the valve 42 is closed, no refrigerant passes over the protector 38, other than suction pressure refrigerant from the chamber 47. However, in the event of an outdoor fan failure, the pressure differential increases, and the valve 42 opens. At that time, refrigerant passes from chamber 44 into chamber 46, through passage 48, into passage 54, into chamber 58 and over protector 38. From that, the refrigerant will pass through passage 60 back to the chamber 47. The refrigerant will typically be at an elevated temperature and should cause protector 38 to open. The valve 42 is generally structured as is known. However, the particular shape of the valve would preferably include an enlarged portion 62 force fit into an opening 63 of the base 30 of the non-orbiting scroll. A second lower portion 64 has smaller outer diameter to provide space for chamber 46.

While the invention discloses the protector mounted in the base of the non-orbiting scroll, other locations remote from the motor would further provide similar benefits. As an example, the benefits of the structure for providing increased sensitivity to the protector will be achieved with the motor protector mounted in the separator plate, or in the housing adjacent to the non-orbiting scroll.

Figure 3A:
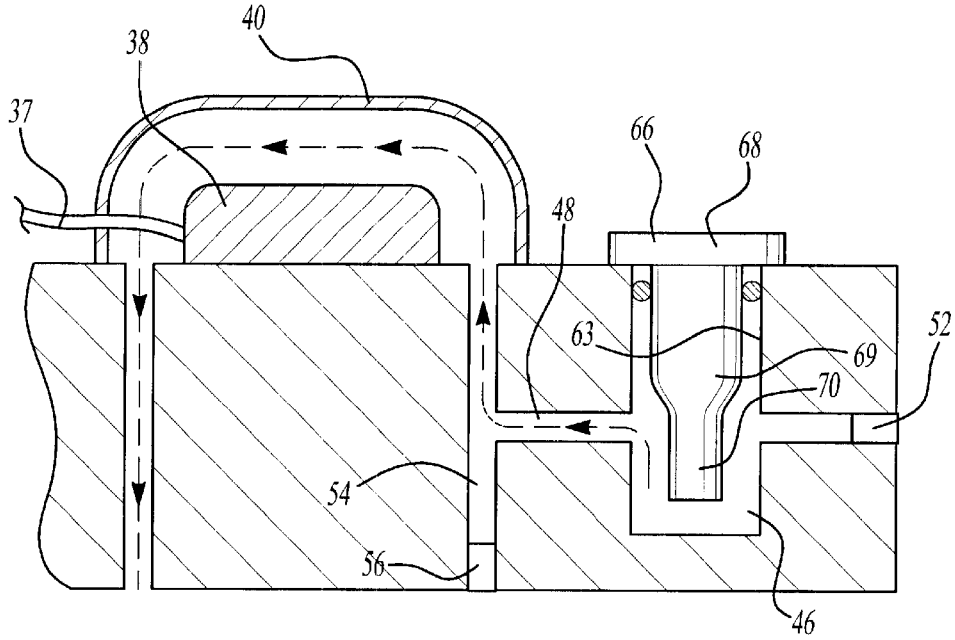
FIG. 3A is an enlarged view of a second embodiment.

FIG. 3A shows another embodiment, which is identical to the first embodiment other than the shape of the valve 66. In the FIG. 3A embodiment, the valve 66 has an enlarged head 68, with a smaller plug portion 69, and an even smaller lower portion 70. The valve and the flow structure operate identical to the FIG. 2 structure.

Figure 3B:
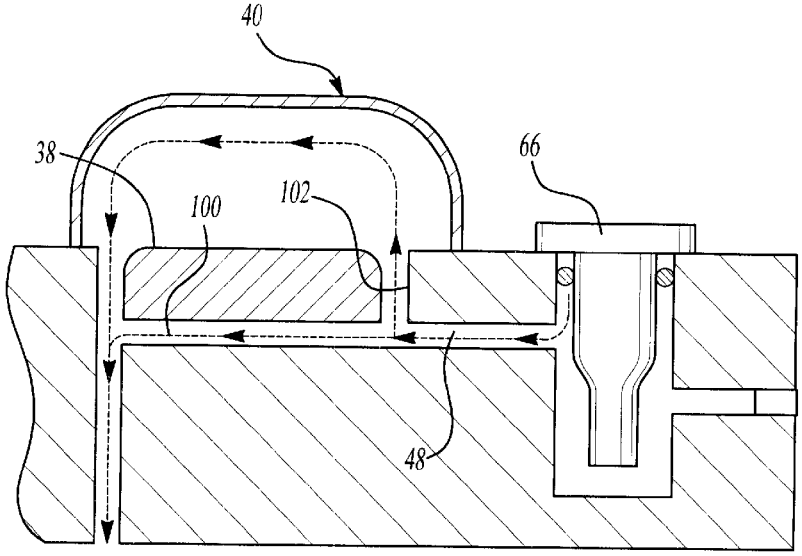
FIG. 3B is an enlarged view of another embodiment.

FIG. 3B shows another embodiment, which is very similar to the FIG. 3A embodiment. However, rather than having passage 54, the passage 48 communicates with a chamber 100 defined by a bore 102 in the base of the non-orbiting scroll. The protector 38 sits in this bore 102, and is covered by the cover 40. This simplifies the arrangement and formation of the various scroll passages by creating one large bore 102, rather than the separate passage 54.

Figure 4:
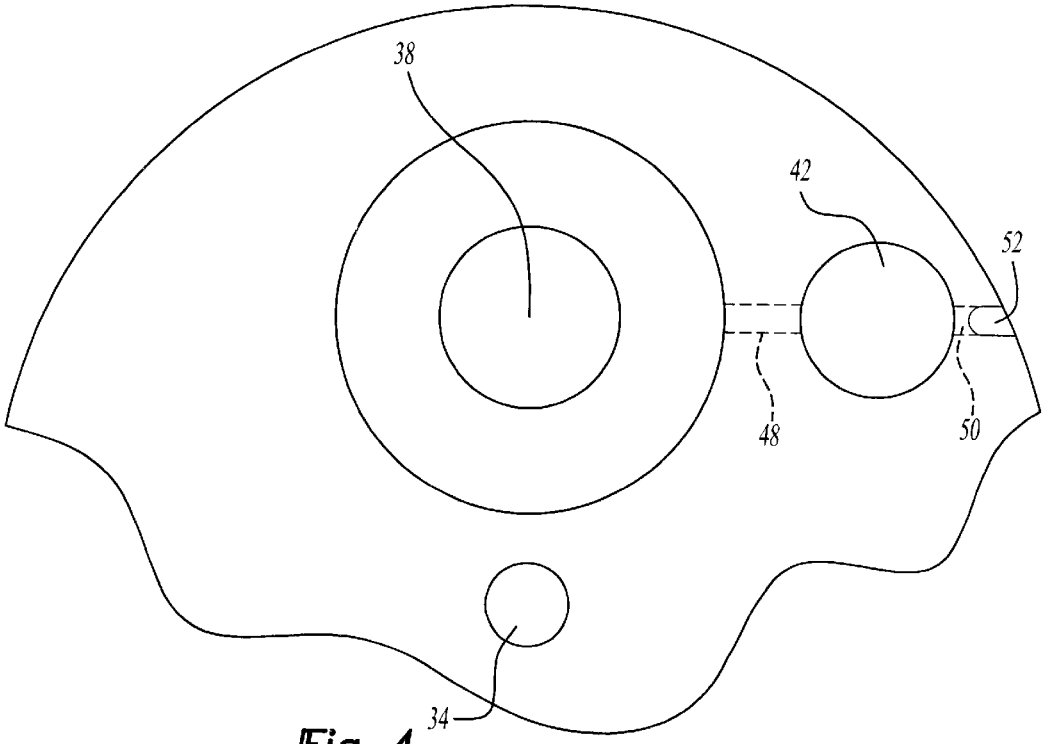
FIG. 4 is a top view of the first embodiment.

FIG. 4 shows a view of the FIG. 2 embodiment. As can be appreciated, the valve 42 and protector 38 are positioned off center from the discharge port 34.

Figure 5A:
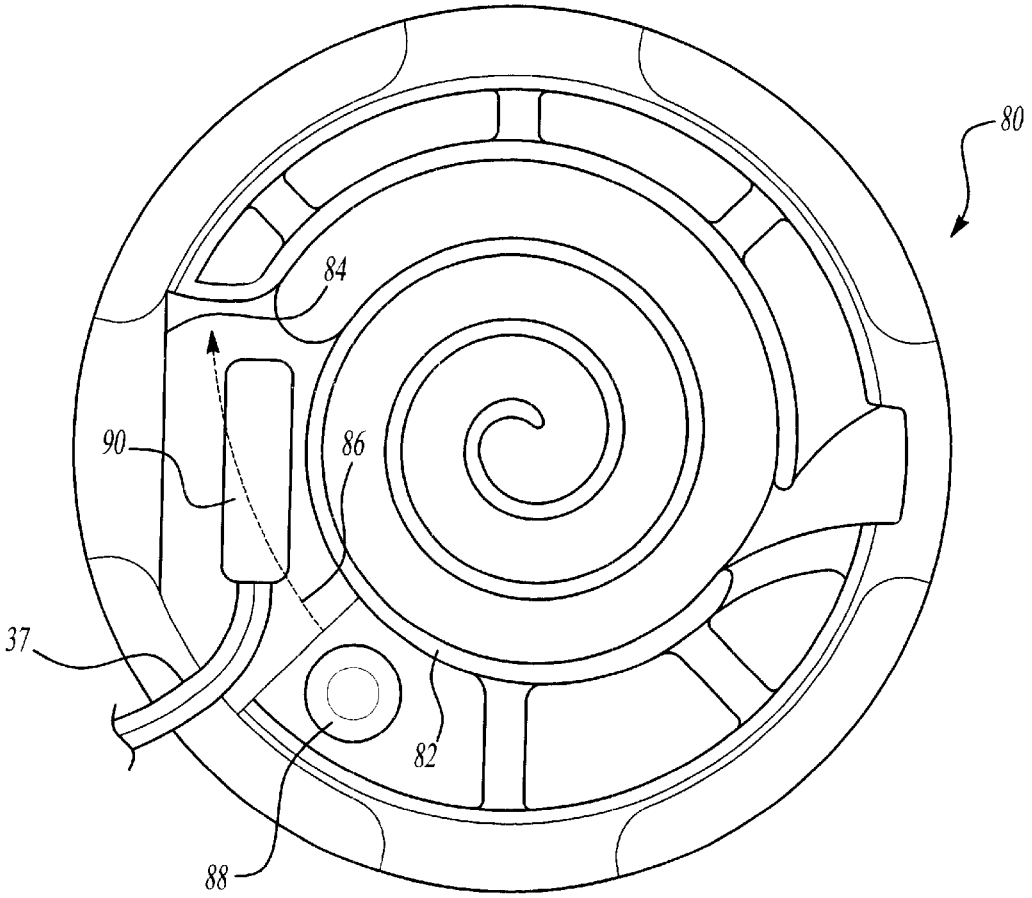
FIG. 5A is a bottom of another embodiment.

FIG. 5A shows another embodiment 80. As shown, the outer wrap 82 of the non-orbiting scroll 84 defines an outer suction passage 86. This is as known in the art. In this embodiment, the pressure relief valve 88 which may be configured as in the earlier embodiments, is positioned within the suction passage 86. The motor protector 90 is further positioned in this passage.

Figure 5B:
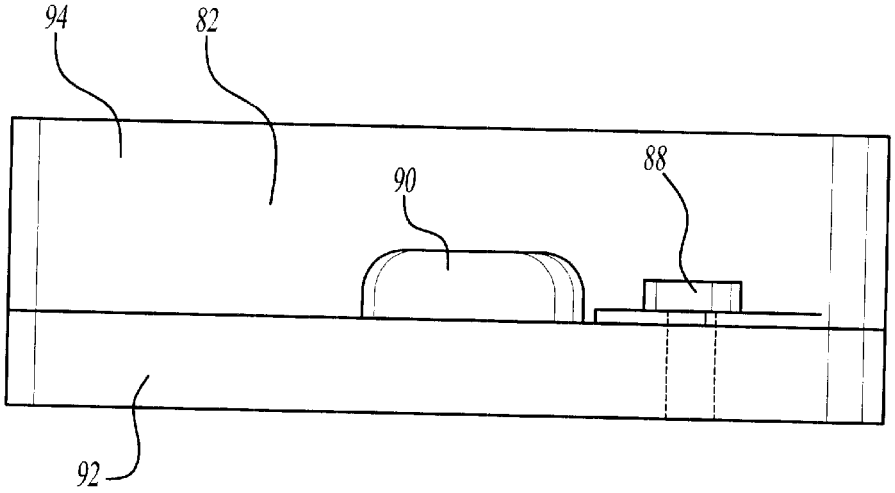
FIG. 5B is a side view of the FIG. 5A embodiment.

As can be appreciated from FIG. 5B, the motor protector 90 is positioned in the base 92 and the valve 88 extends through the base 92. Thus, both devices are typically within the height of the wrap 94 of the non-orbiting scroll 84. In this way, additional height is not required as may be the case for the other embodiments. As with the other embodiments, when there is an increase in the pressure differential discharge pressure refrigerant moves through the valve 88, and passes over the protector 90. The system will operate as in the earlier embodiments.

Figure 6:
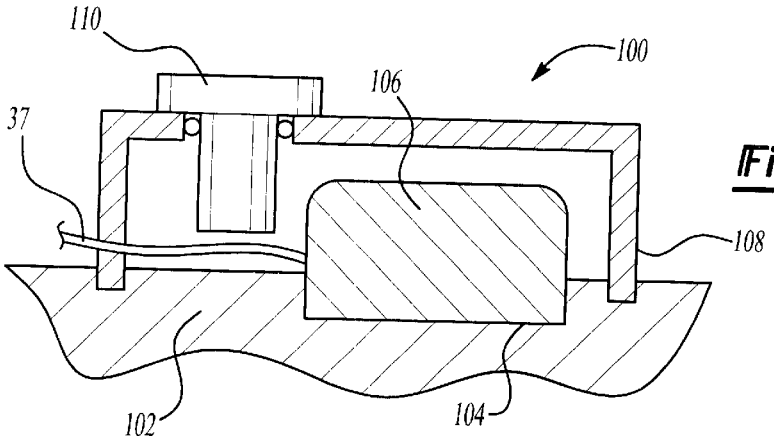
FIG. 6 is another embodiment.

FIG. 6 shows yet another embodiment 100. In this embodiment, the base 102 of the non-orbiting scroll includes a recess 104 to receive the motor protector 106. The protector cover 108 receives the valve 110. This system will operate as in the prior embodiments, however, this embodiment is relatively simplified in that the various passages are eliminated.

Figure 7:
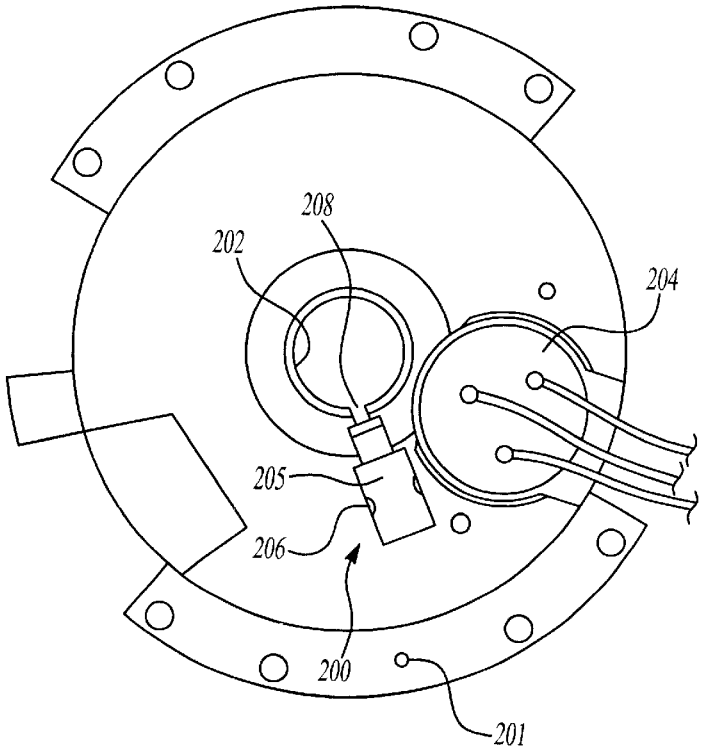
FIG. 7 is another embodiment.

FIG. 7 shows an embodiment 200 wherein the base 201 of the non-orbiting scroll has the discharge port 202 positioned adjacent to a motor protector 204. The pressure relief valve 205 has an outlet in 206 to direct refrigerant over the protector 204.

Figure 8:
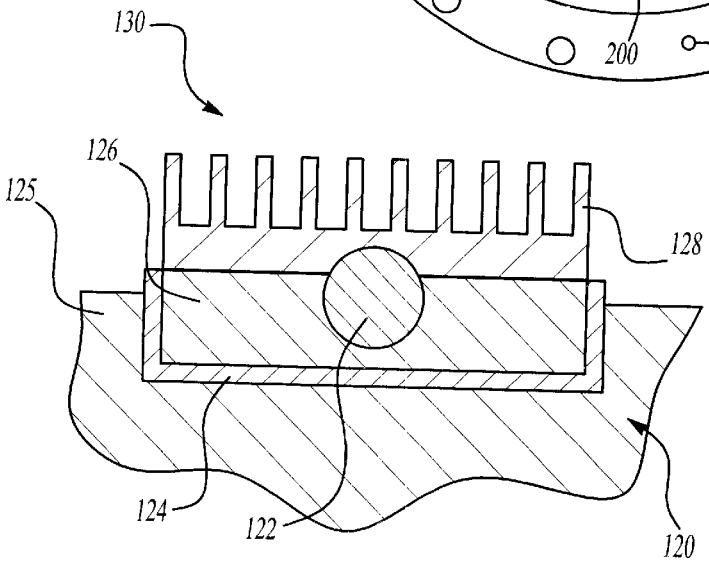
FIG. 8 shows another embodiment.

FIG. 8 shows yet another embodiments 120. In this embodiment the protector 122 is provided with a insulating cover 124 positioned adjacent to the base 125 of the non-orbiting scroll. A first heat sink 126 and a second heat sink 128 surround the motor protector 122. As can be appreciated, the chamber 130 above the heat sink 128 is a discharge pressure chamber. Thus, providing there is a sufficient flow of refrigerant, there will be refrigerant flowing to take heat away from the motor protector 122 through the heat fins on the heat sink 128. However, in the event there is a loss of charge, the volume of refrigerant flowing over these heat fins will decrease. In that event, the heat being taken away from the heat sink 128 will also decrease. The motor protector 122 increases in temperature, and stops operation of the motor. It should be appreciated that the chamber 130 could also be at suction pressure, and that either the suction or discharge pressure chamber will have a decreased volume of refrigerant flow in a loss of charge situation.

While the protector is shown in the base of the non-orbiting scroll, it should be understood that other adjacent locations may also be utilized. As an example, the motor protector could be mounted within a separator plate, or within the housing or crank case of the compressor. Further, while the invention is specifically disclosed as addressing an outdoor fan failure, or a blocked fan condition, other conditions may also cause the appropriate change in pressure differential to result in the control of this application.

Several embodiments of this invention have been disclosed. A worker in this art would recognize that many modifications of these embodiments would also come within the scope of this invention. For that reason, the following claims must be studied to determine the true scope and content of this invention.

What is claimed is:

1. A scroll compressor comprising:

a first scroll member having a base and a generally spiral wrap extending from its said base;

a second scroll member having a base and a generally spiral wrap extending from its said base, said spiral wrap of said first and second scroll members interfitting to define compression chambers, said second scroll member being driven through a shaft by an electric motor to orbit relative to said first scroll member;

a discharge port extending through said base of said first scroll member to a discharge pressure chamber;

a motor protector mounted remotely from said motor, and sealed from said discharge pressure chamber operable to stop operation of said motor if heat conditions adjacent said motor protector indicate an anomaly, or if electrical connections passing through said motor protector indicate an anomaly; and a pressure relief valve positioned to open when the pressure differential between said discharge chamber and a suction chamber exceeds a predetermined amount, said pressure relief valve being operable to pass refrigerant from said discharge chamber over said motor protector in the event that said pressure differential exceeds said predetermined amount.

2. A scroll compressor as recited in claim 1, wherein said motor protector is positioned in said first scroll member.

3. A scroll compressor as recited in claim 2, wherein said motor protector is positioned in a face of said base of said first scroll member remote from said second scroll member.

4. A scroll compressor as recited in claim 2, wherein a passage extends through said base of said first scroll member from said pressure relief valve to a chamber associated with said motor protector, and over said motor protector, a second passage extending from said chamber associated with said motor protector back to said suction chamber.

5. A scroll compressor as recited in claim 2, wherein said pressure relief valve has a generally constant cross-sectional area.

6. A scroll compressor as recited in claim 2, wherein said pressure relief valve has a cross-sectional area having at least two distinct cross-sectional areas to provide additional space near a lower end.

7. A scroll compressor as recited in claim 2, wherein said motor protector is positioned on a face of said base of said first scroll member facing said second scroll member, said motor protector being positioned radially outwardly of said wrap of said first scroll member in a suction space.

8. A scroll compressor as recited in claim 7, wherein said pressure relief valve is positioned outward of said motor protector, and also within said suction space.

9. A scroll compressor as recited in claim 2, wherein said motor protector is provided with a protective cover, and said pressure relief valve extending through said protective cover.

* * * * *